US005974630A

United States Patent [19]

Langen

[11] Patent Number: 5,974,630

[45] Date of Patent: Nov. 2, 1999

[54] SPINNING CAN STAND

[76] Inventor: Manfred Langen, Krefelder Strasse 820, D-41066 Mönchengladbach, Germany

[21] Appl. No.: 09/154,457

[22] Filed: Sep. 16, 1998

[30] Foreign Application Priority Data

Sep. 16, 1997 [DE] Germany ..... 197 40 661

[51] Int. Cl.[6] ..... D01H 9/00

[52] U.S. Cl. ..... 19/159 A; 19/65 A; 19/159 R; 57/281

[58] Field of Search ..... 19/65 A, 159 A, 19/159 R; 57/90, 281

[56] References Cited

U.S. PATENT DOCUMENTS 3,884,026 5/1975 Yoshizawa et al. ..... 19/159 A
4,694,539 9/1987 Langen ..... 19/159 A
4,735,040 4/1988 Pircher ..... 19/159 A
5,257,897 11/1993 Yamamoto et al. ..... 57/281
5,276,947 1/1994 Fritschi et al. ..... 19/159 A
5,333,359 8/1994 Kroupa ..... 19/159 R
5,350,052 9/1994 Gebald et al. ..... 57/281
5,729,868 3/1998 Liedgens et al. ..... 19/159 A

*Primary Examiner*—Michael A. Neas
*Assistant Examiner*—Gary L. Welch
*Attorney, Agent, or Firm*—Collard & Roe, PC

[57] ABSTRACT

A spinning can stand of a fiber sliver-processing machine such as a flyer or a jet spinning frame having a plurality of spindles in at least one row. Rectangular cans are used instead of round cans for reducing the expenditure for exchanging the spinning cans. Each unreeling spinning can or operating can has an instantaneous filling level. The filling level differs between adjacent operating cans by a fraction of the can filling. A full can or reserve can is allocated to the position of the operating can emptied to the greatest extent.

11 Claims, 5 Drawing Sheets

SPINNING CAN STAND

BACKGROUND OF THE INVENTION

1. Field of the Invention

The present invention relates to the spinning can stand of a fiber sliver-processing machine such as a flyer or a jet spinning frame. This machine has a large number of spindles arranged in at least one row. A spinning can or operating can is allocated to each individual spindle which draws off fiber sliver from the operating can. There is at least one row of operating cans allocated to the spindles as a whole.

2. The Prior Art

Fiber sliver-processing machines include stretching machines and machines for preparing the combing process, among others. The term "fiber sliver-processing stations" is used in this connection instead of "spindles".

The present invention, however, is applicable particularly with flyers or jet spinning machines. The spindles of a flyer are generally arranged in two straight rows, which are displaced against each other. The spindles of a jet spinning frame have to be arranged in one straight row. A flyer conventionally comprises at least four straight rows of round operating cans, or "operating rows". If there is a conveying lane (or conveying passageway) between an operating row and the spindles, the fiber sliver pulled off from the operating can may be guided to the processing spindle high above the conveying lane by a creel. Similar measures apply to a jet spinning frame. However, a jet spinning frame conventionally comprises only two rows of round operating cans, as a rule. The fiber slivers processed on such spinning machines are normally supplied by one or by a plurality of stretching machines.

As mentioned above, flyers and jet spinning frames, like other fiber sliver-processing machines, have been supplied heretofore from round spinning cans. Round spinning cans have standard sizes, in particular, standard circular diameters. Systems for changing and transporting these round cans are available. With a flyer, for example, the round spinning cans are moved from a stand-by position into an operating position in an operating row, or the stand-by or reserve cans are set up in a second row. In summary, four rows of round operating cans are allocated to a flyer, and two rows of round cans to a jet spinning machine. A row of reserve cans (i.e., the "reserve row") can be allocated to each row of operating cans.

The work required for changing the round cans is time-consuming if fewer reserve cans are available than operating cans because the empty operating cans have to be replaced by full reserve cans. If, on the other hand, as many reserve cans as operating cans are to be available, costly, driven conveying elements are needed for the cans.

SUMMARY OF THE INVENTION

It is therefore an object of the present invention to overcome the drawbacks of the prior art and to make the changing of cans easier and more economical without increasing the number of operating rows.

It is another object of the present invention to reduce the number of operating rows required to reduce the number of driving paths. In particular, the object of the invention is to facilitate automatization of can changes.

These and other objects are accomplished by a spinning can stand for a fiber sliver processing machine such as a flyer or a jet spinning frame having a plurality of spindles in at least one row. An operating can is allocated to each spindle which removes fiber sliver from the operating can. At least one row of operating cans is allocated to the spindles as a whole.

In the present invention, rectangular cans are used instead of round ones. Rectangular spinning cans are arranged in each operating row. The small rectangular side of the cans is approximately equal to the radius of conventional standard round spinning cans and their large rectangular sides are arranged in a parallel manner.

The goal accomplished by the invention is that instead of having two round cans arranged one after another in two operating rows, only two rectangular cans (of the specified size) standing next to each other in one operating row are now required for a defined amount of fiber material. The two rectangular cans, due to their geometry, can receive even more fiber sliver material than the conventional round cans.

It is possible solely by employing rectangular cans to cut the number of operating rows in the spinning can stand in half. Most importantly, however, the duration of a can change can be highly reduced by turning the fiber sliver over. Furthermore, automation can be substantially advanced as well. Finally, very few costly belt conveyor means are required. Drivable transporters, which are capable of successively serving other machines, suffice instead of such means.

According to another feature of the invention, there are means for achieving an instantaneous filling level in each operating can. This filling level may be different from the one of an adjacent operating can by a defined fraction of a can filling. Furthermore, a full can, i.e., a so-called reserve can, is allocated to the position of the operating can emptied most. The "defined fraction" may generally amount to 0% to 100% of the can filling. The difference in the filling of adjacent cans thus may be close to zero, so that adjacent cans are equally full and (later) equally empty. Also, many actual differences in the can fillings are conceivable. Preferably, the filling level of an operating can differs instantaneously from the one of an adjacent operating can—of the same or of an adjacent operating row—by a quarter or half of the can filling. In each operating row, at most two different filling levels of instantaneously emptying operating cans should preferably occur.

For a spinning can stand of a jet spinning frame with only one operating row, this means that the filling level of adjacent operating cans in the row should preferably differ by approximately half of a can's filling volume. With a flyer having two operating rows, an adjacent operating can may stand in the same or in an adjacent operating row. Similar considerations apply to stretching machines with suitable adaptation as well, and also to machines for preparing the combing process and other fiber sliver processing machinery. Accordingly, the filling level of cans within the same operating row may differ from each other by a certain fraction of a can filling, including zero.

The invention, therefore, also includes the case where all cans in the same operating row have the same filling level, and where the difference in the filling level by a defined fraction is between one operating row to the other.

The change from round to rectangular cans of the specified size ratio leaves the division of the operating position of the respective machine unchanged. Another advantage of the present invention is the possibility of a can change from a nondriven position to another, driven position. All can places or positions can remain "passive", i.e., as mentioned above, no driving belts or other transport means extending along the conveying lanes are required.

For the spinning can stand of a flyer, a preferred embodiment comprises two operating rows with rectangular operating cans set up close to each other. The rectangular reserve cans are set up in a stand-by row, which exists separately between the operating rows. There is also a conveying lane or passageway for transporting empty or full cans between the operating row and stand-by row. This lane serves as a connection with a machine upstream or with a storage facility or the like, whereby before a can change, the stand-by row contains full cans (reserve cans) with their large rectangular sides extending parallel with each other. The full cans are positioned so as leave gaps in between the cans for receiving an empty can in each gap. A full can is then available in the stand-by row for each operating can running empty as the flyer is operating. In the course of a can change, the emptied operating can is pulled from the operating row and pushed into a gap (e.g., into the closest gap) in the stand-by row. The full "stand-by" or reserve can is subsequently moved from the stand-by-row into the operating row. This operation can be tried out mechanically within the framework of the invention, such as automatically with the help of a can changer, or also manually.

As a rule, the entire machine is shut down as the cans are being exchanged between the stand-by and the operating rows. Thus, spindles pulling material from the relatively fuller operating cans, if any, are stopped as well. The machine is switched on again for the spinning operation only after the empty cans in an operating row have been replaced and the head or leading ends of the slivers have been attached to the ends of the unreeled slivers as well as to the spindles. The empty cans transferred into the stand-by row can then be replaced in the course of the spinning operation by full cans individually or in groups, either manually or with the help a transport carriage.

When the above example is applied to a jet spinning frame, its row of spindles has an operating row of operating cans set up close to each other. The reserve cans have to be set up in a stand-by row next to the operating row directly adjacent to it, or separated from the operating row by a conveying lane or passageway (as specified above). On this type of machine too, prior to can change, the stand-by row should contain full cans with their large rectangular sides extending parallel with each other. The cans should be positioned so as to provide gaps in between the cans for receiving empty cans. The empty cans in the operating row are then replaced by full cans from the stand-by row in basically the same way as on a flyer-type machine.

The distribution or combination of operating and stand-by rows can be realized in connection with fiber sliver-processing machines in different ways from the manner described above. According to another feature of the invention, there are exactly two operating rows with operating cans set up close to each other on a flyer, and a stand-by row of full or reserve cans set up directly adjacent to each operating row. The cans or the can positions of each of the pairs of rows of rectangular cans consisting of an operating row and a stand-by row have to border with their narrow rectangular sides on both sides on an O-axis extending parallel with the rows of spindles. Again, there is a conveying lane for transporting empty and full cans around the pairs of rows as well as between the rows with a connection to a machine upstream. The stand-by row has to be designed in such a way that it can be occupied by full cans set up close to each other.

When the operating cans in an operating row containing the lesser or the least amount of fiber sliver have run completely empty (or if, in the extreme case, all operating cans have run completely empty at the same time), the unreeling of sliver can be changed from empty cans to an adjacent full can already positioned in the adjacent stand-by row. No movement of cans has to take place for this change in the spinning can stand. The reserve or full can set up in the stand-by row thus becomes an operating can "on the spot" and the stand-by row becomes to this extent an operating row. Therefore, under this aspect of the invention, the functions of the cans and rows or each pair of rows are exchanged without any movement of cans. A very similar situation applies to the case of a spinning can stand with only one pair of can rows. For example, when this feature of the invention is applied to a jet spinning frame where there is one single pair of rows, the function of the rows or cans changes in the manner specified above.

According to a further development of the invention, the spinning can stand of a flyer can have exactly four operating rows where the filling level is the same in each row, but changes from row to row (in this case, too, all operating cans basically may have the same filling level).

If the filling level changes from row to row, for example by ¼ or ½ can filling, the operating cans contained in the so-called "graded" operating rows with cans with equal filling levels should be set up with gaps in between for receiving one reserve can. Two operating rows are preferably combined in double rows. In such double rows, the small rectangular sides of the cans again must border on both sides of an O-axis which extends parallel with the spindle rows. A conveying passageway for each empty and full can may be provided around the double rows and between each two double rows. The operating cans present in each operating row should instantaneously all have the same filling level at least by blocks. The term "by blocks" (or by sections) relates to one group of cans, e.g. to ½, ⅓ or ¼ of row of cans, or to a group of cans that can be simultaneously exchanged with a changing device. Of course, the same applies again if the invention is applied to a jet spinning frame, whereby there are exactly two operating rows (each "graded" and with gaps) in one double row.

In these cases, where the cans of a row or of a block or section have the same filling level and are thus graded, all cans with the same filling level can be replaced simultaneously. This feature of the invention offers the further advantage that reserve cans can be previously set up in the gaps between each two operating cans still running empty. This means that as cans are running empty, a change can be made from an empty can to a full reserve can standing next to the empty can without requiring any direct movement of cans.

If the leading end of the fiber sliver of each reserve can in a stand-by row made available in a gap of an operating row is positioned in a defined spot on the can, this leading end of the new sliver can be easily and safely seized by an automatic sliver applicator and automatically applied to the trailing end of the sliver just unreeled. The defined position of the leading end of the sliver is preferably located on a narrow or small side of the respective rectangular can. If such narrow sides of the rectangular cans are substantially disposed on one axis, e.g. on an o-axis as explained above, the sliver applicator or sliver connector needs to perform only a linear driving motion for executing its function.

BRIEF DESCRIPTION OF THE DRAWINGS

Other objects and features of the present invention will become apparent from the following detailed description considered in connection with the accompanying drawings which disclose a few embodiments of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION OF PREFERRED EMBODIMENTS

Figure 1:
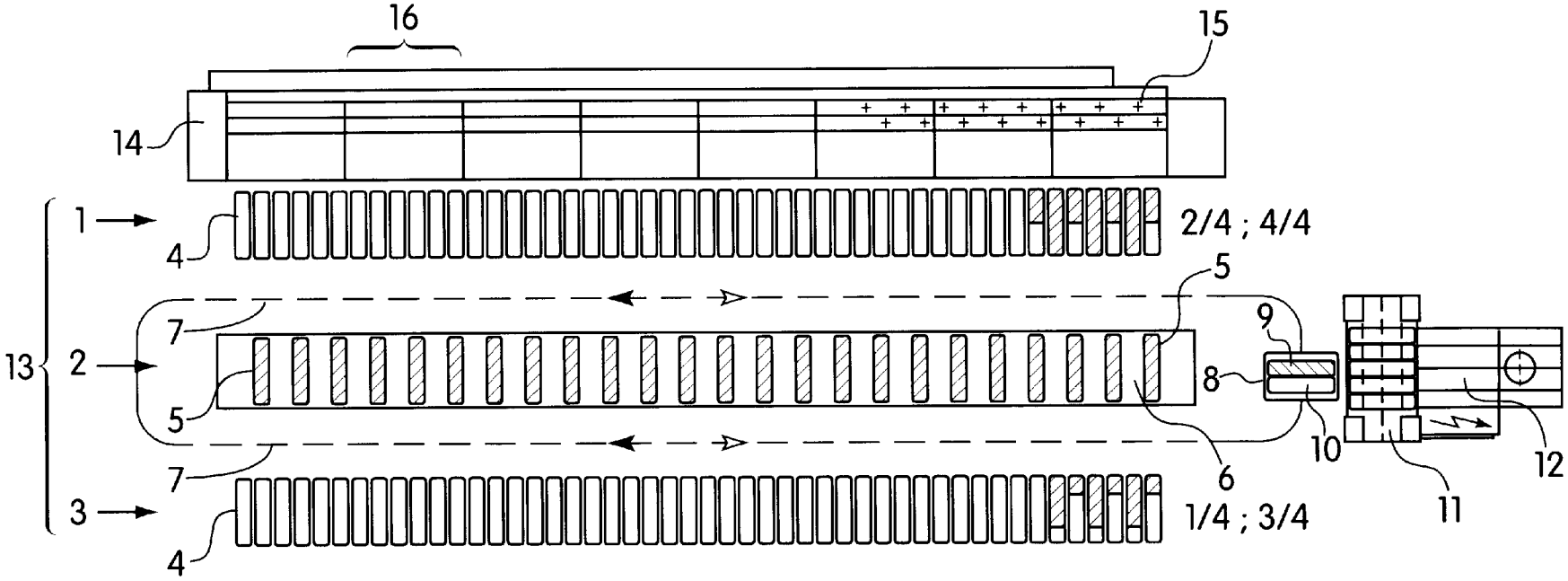
FIG. 1 shows a spinning can stand of a flyer with two separate operating rows and one stand-by row, as well as with a conveying lane extending all around the stand-by row between the operating rows.

Referring in detail to the drawings, FIG. 1 shows the spinning can stand of a flyer consisting of two operating rows 1 and 2 and one stand-by row 3. only operating cans 4 are contained in each of operating rows 1 and 2, and only reserve or full cans 5 are present in stand-by row 3 in the situation shown. There is a gap 6 between each two full cans 5 for inserting an empty can in the gaps. A conveying lane 7 extends around stand-by lane 3 between the two operating rows 1 and 2. In conveying lane 7, a carriage 8 is capable of transporting full cans 9 or empty cans 10 between a storage unit 11 of a stretching machine 12 and stand-by row 3.

In the example shown, spinning can stand 13 consisting of operating rows 1 and 2 and stand-by row 3 is associated with a flyer 14. The fiber sliver pulled from individual operating cans 4 is pulled up (not shown) and transported to spindles 15 of flyer 14 via a creel arranged above can rows 1 to 3 and conveying lane 7.

In the embodiment according to FIG. 1, an instantaneous filling level is available in each operating can 4 of operating rows 1 and 2. The filling level is different by half of a can filling from the instantaneous filling level in each of the adjacent operating cans 4 positioned in the same operating row 1, 2. Therefore, as shown in FIG. 1, operating cans 4 of operating row 1 are filled up to ¾th or ⁴⁄₄th of their volume, and operating cans 4 in operating row 2 up to ¼th or ¾th of their volume. FIG. 1 shows, furthermore, that the filling level of an operating can 4 of operating row 1 differs from the filling level of an adjacent operating can 4 in operating row 2 by ¼th of its volume.

When an operating can 4 of operating row 2 filled up to ¼ of its volume has finally run completely empty, the machine (flyer 14) is stopped and the empty cans are pulled into gaps 6 of stand-by row 3. The full reserve cans 5 of stand-by row 3 are then pushed into the resulting free places or gaps of operating row 2 that have now become available. After all empty cans of row 2 have been replaced by full cans, the machine is put again into operation. When the machine starts to operate again, a filling level ratio of ¾ to ⁴⁄₄ is then present in operating row 2, as well as a ratio of ¼ to ¾ in operating row 1. Each empty can can be replaced by a full can either by hand or by a manipulator (not shown). The empty cans 10 transported in the course of the exchange into the stand-by row can be picked up by a carriage 8 and replaced by full cans 9 from storage unit 11. In this process, the full cans 9 are placed in gaps now available between the empty cans 10 in stand-by row 3.

As shown in the drawings, carriage 8 may be provided with two setting positions or with only one setting position, but also with any desired number of set-up positions for cans. For example, it may be designed in such a way that it is capable of picking up or depositing a plurality of cans at the same time. The exchange of cans in stand-by row 3 can be accelerated in this way. For example, carriage 8 may exchange cans by sections or blocks. A section denotes a group 16 of spindles on flyer 14. A block denotes several sections 16, for example half of the length or the total length of flyer 14 or of an operating or stand-by row of cans.

Figure 2:
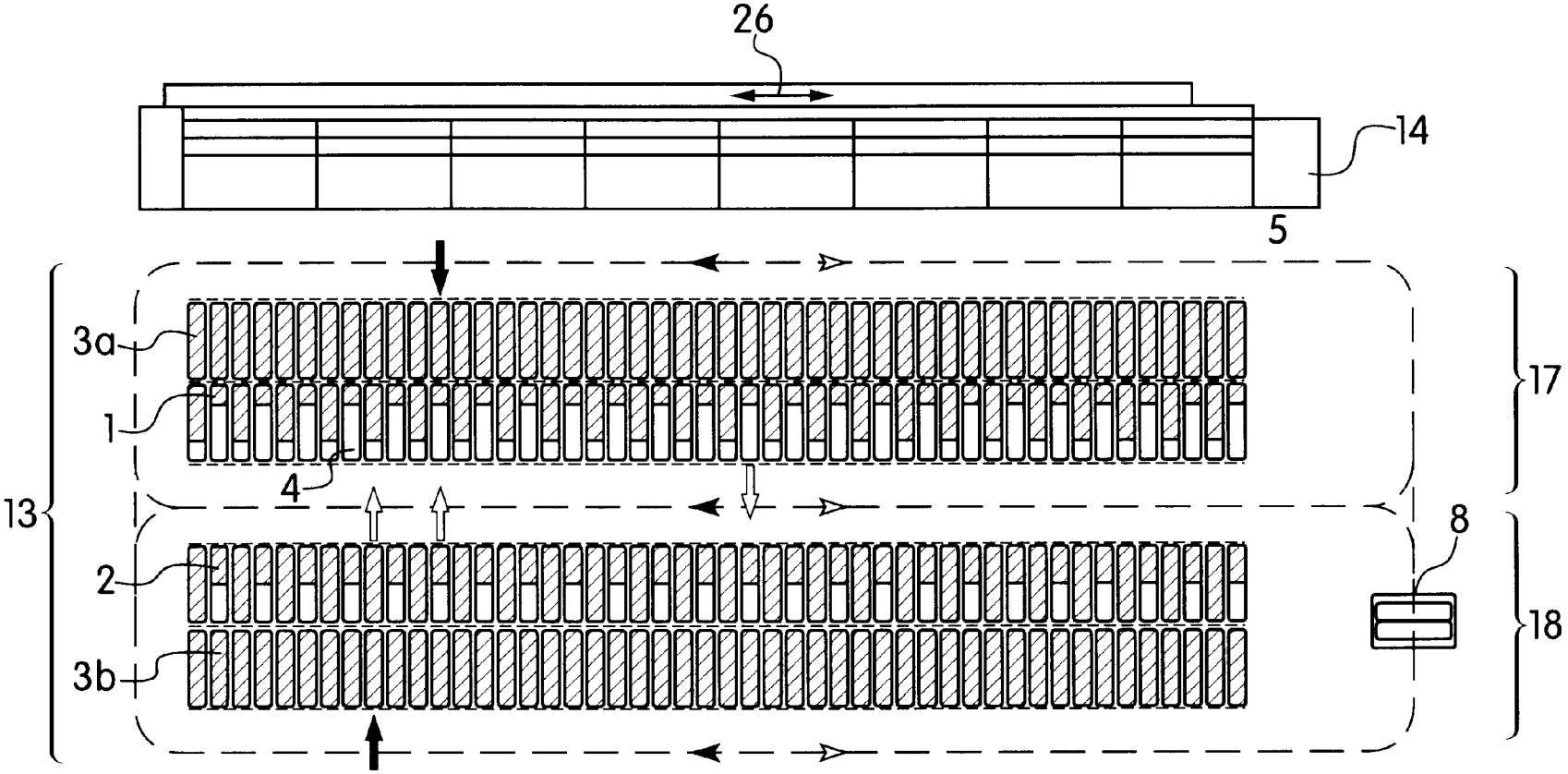
FIG. 2 shows a spinning can stand with two double rows of cans each consisting of an operating row and a stand-by row.

FIG. 2 shows a spinning can stand 13 of a flyer 14, comprising two pairs of can rows 17 and 18 and a conveying lane extending around and between the pairs of rows. Each of can row pairs 17, 18 consists of an operating row 1 and 2, respectively, and a stand-by row 3*a* and, respectively, 3*b*. In the present embodiment, a filling level ratio is selected between adjacent operating cans 4 within operating rows 1 and 2 corresponding with the one shown in FIG. 1. Since as many reserve cans as operating cans are present in can stand 13 in the embodiment according to FIG. 2, all operating cans may have the same filling level (similar to FIGS. 3 and 4 described below), as opposed to the embodiment of FIG. 1.

Even when the operating cans with different filling levels have run empty as shown in FIG. 2, such as the cans of operating row 1 filled up to ¼th of their volume, no can has to be moved for "spinning on" the next reserve can because the head end of the sliver of the reserve or full can of stand-by row 3*a* bordering on the empty can is pulled off, the result being that stand-by row 3*a* now becomes an operating row.

With the mode of operation or arrangement of the can in spinning can stand 13 according to FIG. 2, the shutdown time of flyer 14 for an exchange of cans is substantially reduced as compared to the case shown in FIG. 1, because it is only necessary to attach the sliver pulled from one can to the adjacent can to change cans. The previously emptied can is subsequently picked up by carriage 8 and replaced by a new full can. Eliminating the need for shifting cans when changing from an operating to a reserve can results in an enormous time saving when changing slivers. In addition, the machine shutdown time is reduced accordingly, and results in an increase in the efficiency of the machine.

In FIGS. 1 and 2, cans with different filling levels alternate with each other in each operating row. In the embodiment according to FIG. 3, operating cans 4*a*, 4*b*, 4*c* and 4*d* are shown in operating rows 1, 2, 21 and 22, respectively. These cans are arranged in a row having the same filling level, which means the operating cans of the same operating row are somewhat "sorted" (or "graded"). In the embodiment according to FIG. 3, the four operating rows 1, 2, 21 and 22 of spinning can stand 13 consist of two double rows 23 and 24, where operating cans 4 are set with gaps in between. A gap 6 is therefore present between each two operating cans 4*a*, 4*b*, 4*c*, 4*d*. A full can 9 can be positioned in the gap by carriage 8. According to FIG. 3, gaps 6 in operating row 4*a* would be filled first with full cans 9 so that full cans are available when cans 4*a* run empty.

Figure 3:
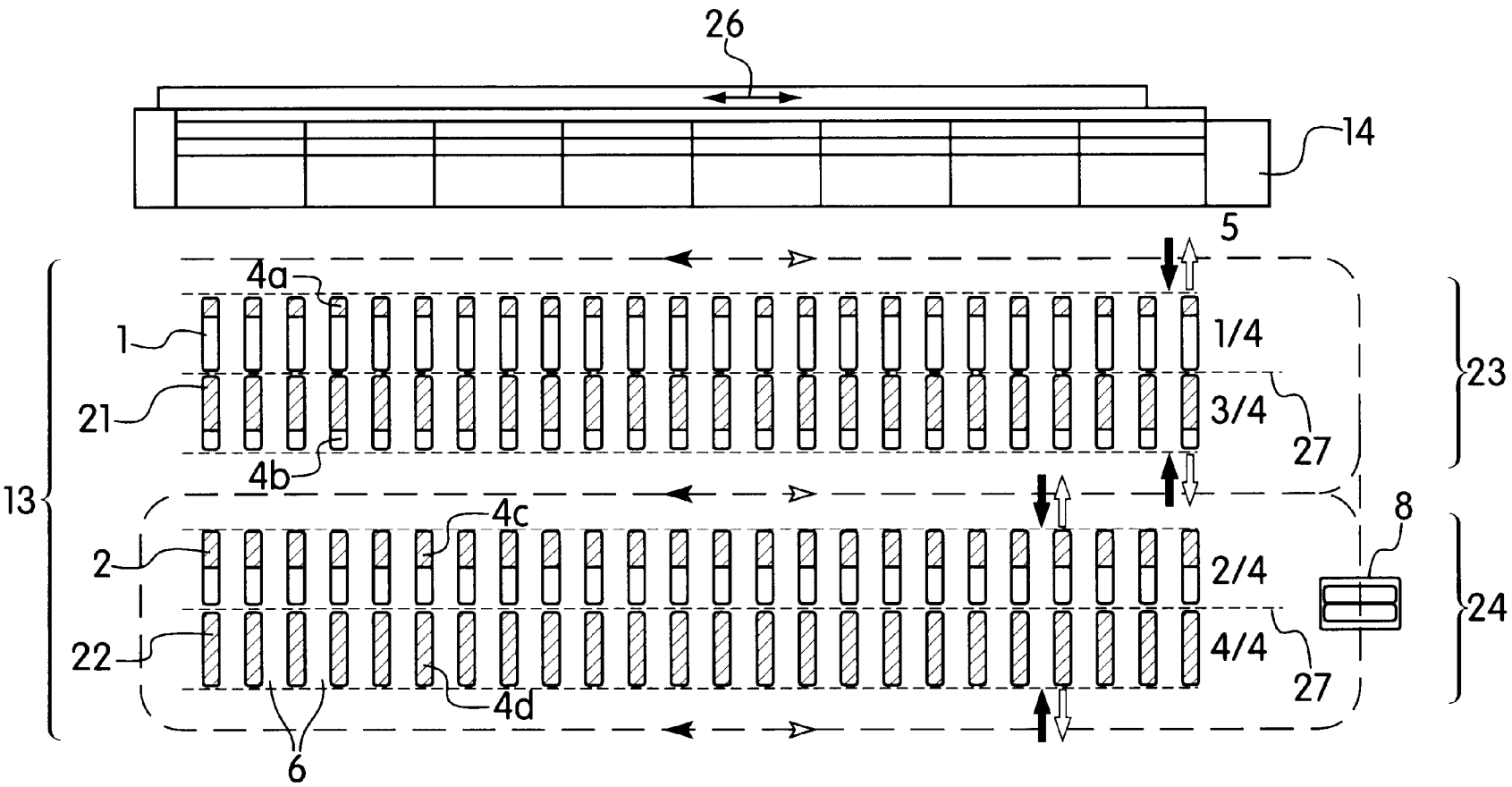
FIG. 3 shows a spinning can stand of a flyer with two double rows of operating cans, whereby only cans having the same filling level are contained in each operating row.

Many parts of the arrangement according to FIG. 3 correspond with the device described above. A special feature of spinning can stand 13 according to FIG. 3 is that the small rectangular sides 25 of the cans of the pairs of operating rows 1, 21 and 2, 22 each forming a double row 23, 24 border on both sides on an o-axis 27 extending parallel with the longitudinal direction 26 of flyer 14. A sliver applicator 28 can be movably supported along this o-axis, moving in the direction of travel 29. If the head end of the sliver of each reserve or full can is positioned in a defined place, preferably on the small rectangular side 25 of the respective full can 5, sliver applicator 28, in the course of its travel in driving direction 29 (e.g. on the o-axis) can seize the leading ends of the slivers without problems and automatically apply the leading end to the trailing end of the sliver previously unreeled.

In the embodiment according to FIG. 3, the shutdown times are even shorter than with the representation according to FIG. 2 because not only is the time for exchanging cans during a machine shutdown saved but also a major part of the time needed for applying the sliver. Furthermore, the manual labor for applying the sliver to the trailing end of the sliver unreeled from the can is omitted. Of course, an automatic sliver applicator can be used for positioning and operating in the embodiment according to FIG. 2 by supplementing the applicator accordingly.

The embodiment of the spinning can stand according to FIG. 3 no longer comprises a typical stand-by row because the row is replaced by the gaps 6 between each two operating cans. When an operating can has run empty, its place is taken by a reserve can which is already available next to the operating can. Therefore, the reserve cans must be pushed previously into the gaps 6 between each two operating cans 4, i.e., as the operating cans are being emptied. As previously mentioned, it is preferable if all operating cans 4 have the same filling level, especially if the slivers are applied automatically.

Figure 4:
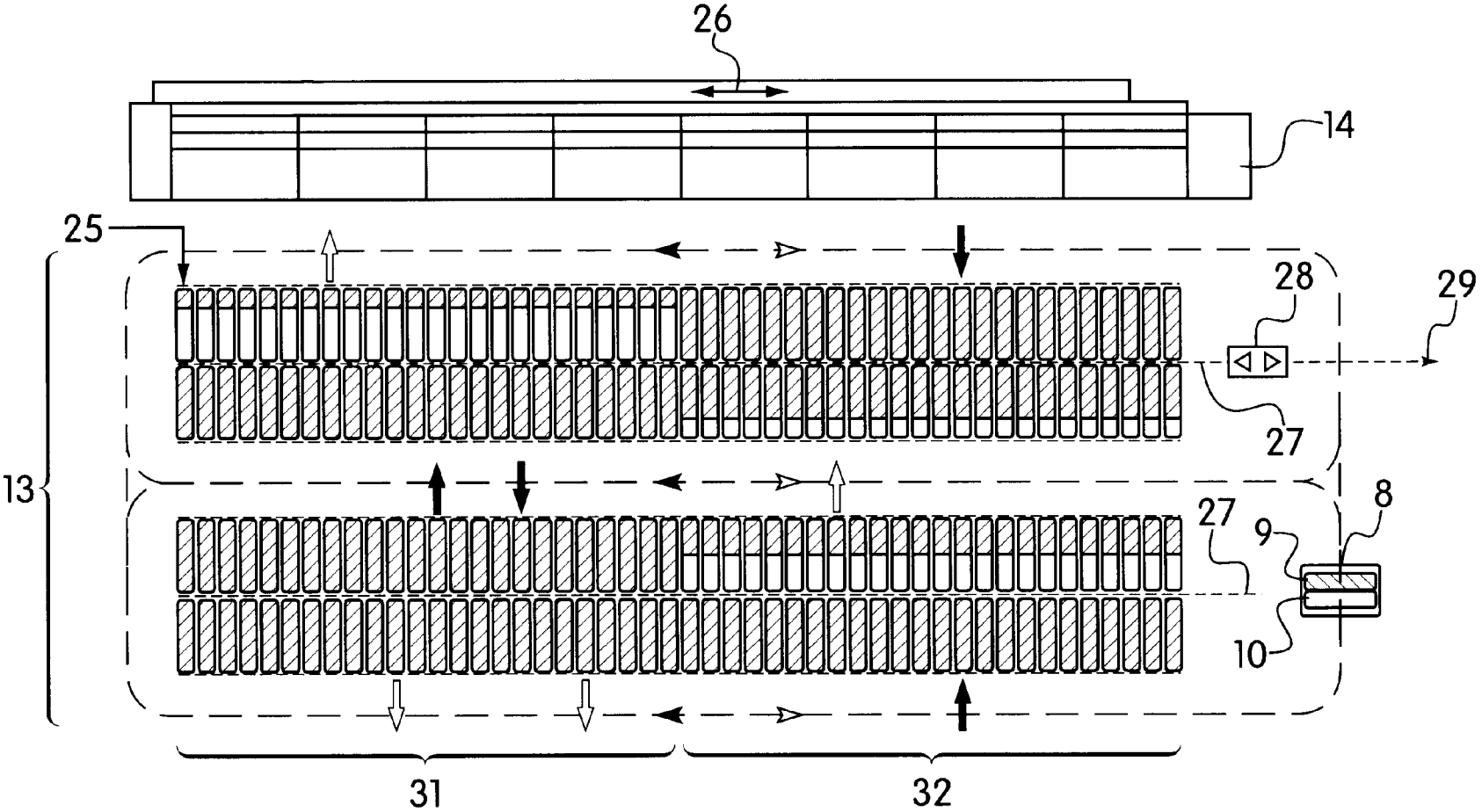
FIG. 4 shows a spinning can stand similar to the one shown in FIG. 3, whereby the cans of each operating row have the same filling level by blocks or sections.

The arrangement of spinning cans in stand 13 can be simplified even further if, according to FIG. 4, operating cans 4*a* to 4*d* and the reserve cans are positioned in blocks 31, 32 next to each other or one after the other in double rows 23, 24. In this case, the two blocks 31 and 32 basically contain exactly as many operating cans 4 and gaps 6 filled with rectangular cans as operating row 4*a* in FIG. 3. The difference lies essentially in the fact that only operating cans 4*a* are now contained in a block 31, and only reserve cans 4*b* are in block 32 standing next to reserve cans 4*a* in block 31. The operating and reserve cans of double row 23 or 24 border on each other with their narrow sides 25 along o-axis 27. This, of course, applies to other spinning in arrangements such as the embodiment according to FIG. 2.

After the operating cans 4*a* of blocks 31 and 32, which in FIG. 4 are still filled up to ¼th of their volume, have been emptied, the trailing ends of the slivers of the unreeled cans 4*a* are applied to the leading ends of the slivers in the full cans 4*b* standing behind the unreeled cans. In the present case, too, application of the sliver can be automated with a sliver applicator 28. Furthermore, it is possible remove the empty cans now present in blocks 31 and 32 in blocks or at least by groups and to replace them by new full cans. The process is simplified further by such a block exchange, in which several cans are replaced simultaneously. If the operating cans are filled everywhere to the same level, a block will comprise all operating cans.

Figure 5:
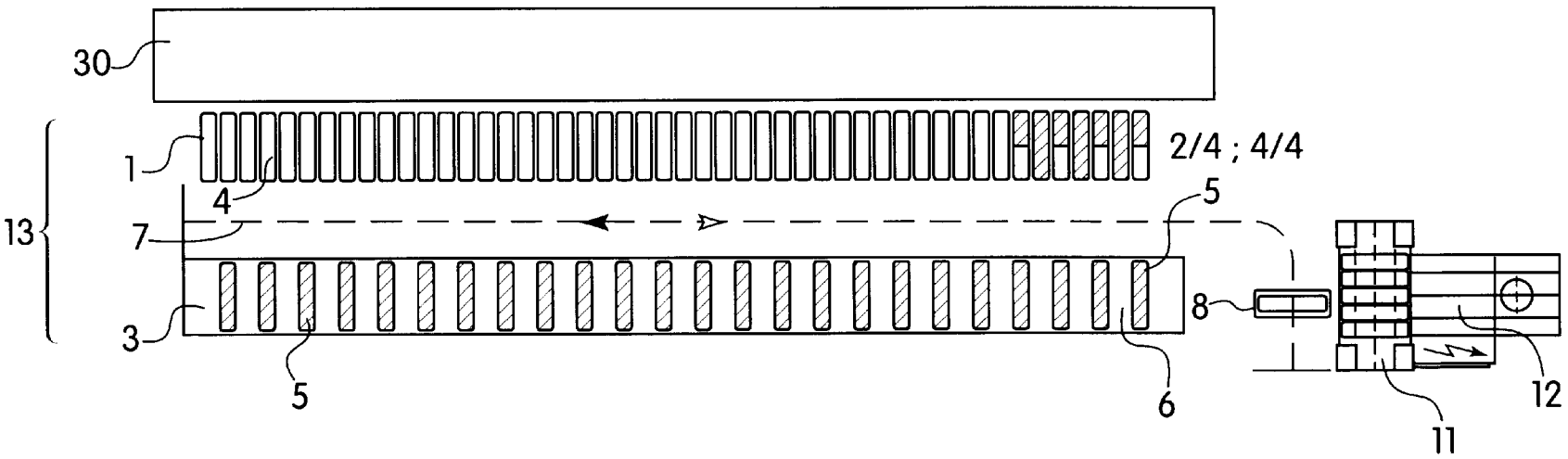
FIG. 5 shows the spinning can stand of a jet spinning frame comprising one operating row and one stand-by row separated from each other by a conveying lane.

FIG. 5 shows the basic design of spinning can stand 13 of FIG. 1 for the case of a jet spinning frame 30. If need be, the one operating row 1 contains unreeling operating cans 4 with two different filling levels (e.g. differing from each other by ½ can filling). In the embodiment according to FIG. 5, cans 1 are shown with filling levels of ¾th and ¼th of their volume. A stand-by row 3 is allocated to operating row 1 according to FIG. 5. This stand-by row is substantially identical to the one in FIG. 1. Stand-by row 3 can be serviced by carriage 8 from storage 11 of a stretcher 12 along conveying lane 7 in the same way as in FIG. 1. The variations according to FIGS. 2 to 4 can be implemented accordingly for a jet spinning frame 30, in which half as many operating rows are instantaneously unreeled as with flyer 14. Also, the operating and stand-by rows 1 and 5 according to FIG. 5 may be completely moved up closer together (similar to the way in FIG. 2). Conveying lane 7 then extends around row pair 1, 3 so formed.

Thus, the invention is a spinning can stand of a fiber sliver-processing machine such as a flyer or a jet spinning frame having a great number of spindles in at least one row. Rectangular cans are employed instead of round cans in order to reduce the expenditure for exchanging the spinning cans. Each unreeling spinning can or operating can has an instantaneous filling level that is different from the one of each adjacent operating can by a defined fraction of the can filling. A full can (reserve can) is allocated to the position of the operating can emptied most.

Accordingly, while a few embodiments of the present invention have been shown and described, it is to be understood that many changes and modifications may be made there unto without departing from the spirit and scope of the invention as defined in the appended claims.

What is claimed is:

1. A spinning can stand for a fiber sliver processing machine having a plurality of spindles in at least one row, comprising:

a plurality of rectangular operating cans arranged in two rows, each operating can being located close to an adjacent operating can, and each can being allocated to an individual spindle for taking off fiber slivers from each can, each can having two small rectangular sides and two large rectangular sides, wherein said at least one row of cans is arranged so that the large rectangular sides are parallel with each other, and wherein the stand is associated with a flyer, and further comprising a row of rectangular reserve cans arranged between the two rows of operating cans, and a conveying lane for full and empty cans arranged between the rows of operating cans and the row of reserve cans, wherein each reserve can has two sets of small rectangular sides and two sets of large rectangular sides, the large rectangular sides being parallel to each other, and wherein the reserve cans are arranged with a gap between each reserve can for receiving an empty operating can.

2. The spinning can stand according to claim 1, wherein each operating can has a different filling level from an adjacent operating can, each filling level differing from a fraction of 0 to 100% of a can's filling volume, and further comprising a full reserve can allocated to a position of an operating can that is most empty.

3. The spinning can stand according to claim 2, wherein the filling level of an operating can differs from an adjacent can in the same row by a ratio selected from the group consisting of ¼, ½ and ¾ of a can's filling volume and wherein each row contains operating cans with two different filling levels.

4. The spinning can stand according to claim 2, wherein there are at least two rows of operating cans and wherein the filling level of an operating can differs from an adjacent can in an adjacent row and wherein each row only contains operating cans of the same filling level.

5. A spinning can stand for a fiber sliver processing machine having a plurality of spindles in at least one row, comprising:

a plurality of rectangular operating cans arranged in one row, each operating can being located close to an adjacent operating can, and each can being allocated to an individual spindle for taking off fiber slivers from each can, each can having two small rectangular sides and two large rectangular sides, wherein said at least one row of cans is arranged so that the large rectangular sides are parallel with each other, wherein the stand is associated with a jet spinning frame and further comprising a row of rectangular reserve cans next to the row of operating cans and row of reserve cans for conveying full and empty cans, said lane connecting to a stretching machine, wherein the reserve cans have two sets of small rectangular sides and two sets of large rectangular sides and wherein the reserve cans are arranged spaced from each other with a gap for receiving an empty operating can and having their large rectangular sides parallel to each other.

6. A spinning can stand for a fiber sliver processing machine having a plurality of spindles in at least one row, comprising:

a plurality of rectangular operating cans arranged in at least two rows, each can being allocated to an individual spindle for taking off fiber slivers from each can, each can having two small rectangular sides and two large rectangular sides, wherein said at least one row of cans is arranged so that the large rectangular sides are parallel with each other, wherein the stand is associated with a flyer having a longitudinal direction, and further comprising a row of rectangular reserve cans arranged directly next to each row of operating cans so that there are two pairs of can rows, each reserve can having two small rectangular sides and two large rectangular sides, wherein the cans of each pair of rows have their small rectangular sides border an o-axis extending parallel to the longitudinal direction of the flyer, and wherein there is a conveying lane for empty and full cans around and between the two pairs of rows.

7. The spinning can stand according to claim 6, wherein the the reserve cans are exchanged with operating cans in blocks of cans.

8. A spinning can stand for a fiber sliver processing machine having a plurality of spindles in at least one row, comprising:

a plurality of rectangular operating cans arranged in exactly four rows forming two pairs of rows, each can being allocated to an individual spindle for taking off fiber slivers from each can, each operating can being arranged with a gap between an adjacent operating can for receiving a reserve can in each gap, each can having two rectangular sides and two large rectangular sides, wherein said at least one row of cans is arranged to that the large rectangular sides are parallel with each other, wherein the stand is associated with a flyer having a longitudinal direction and wherein the small rectangular sides of each operating can borders an o-axis extending parallel to the longitudinal direction of the flyer, wherein there is a conveying lane for transporting full and empty cans extending around the rows and between the pair of rows, and wherein the operating cans are divided into blocks, so that the operating cans within each block all have the same filling level.

9. A spinning can stand for a fiber sliver processing machine having a plurality of spindles in at least one row, comprising:

a plurality of rectangular operating cans arranged in exactly two rows, each can spaced from an adjacent can by a gap, and each can being allocated to an individual spindle for taking off fiber slivers from each can, each can having two small rectangular sides and two large rectangular sides, wherein said at least one row of cans is arranged so that the large rectangular sides are parallel with each other, wherein the stand is associated with a jet spinning frame, and further comprising a plurality of reserve cans having small rectangular sides and large rectangular sides for placement into said gaps, said rows of operating cans forming a double row, wherein the small rectangular sides of the operating cans border an o-axis extending parallel to the row of spindles, and wherein there is a conveying lane for transporting full and empty cans to and from a machine upstream and wherein all of the operating cans are divided into blocks such that all of the cans in a block have the same filling level.

10. The spinning can stand according to claim 9, wherein the leading end of a fiber sliver of each reserve can is disposed positioned in a defined place and is locatable by an automatic sliver applicator.

11. The spinning can stand according to claim 10, wherein the leading end of the sliver of a can projects from one of the small rectangular side bordering the o-axis.

* * * * *